United States Patent [19]

Ryan

[11] Patent Number: 4,536,184

[45] Date of Patent: Aug. 20, 1985

[54] OVERPRINTING OF DYE COLORED POLY(VINYL CHLORIDE) RESINS

[75] Inventor: Thomas D. Ryan, Escondido, Calif.

[73] Assignee: Formulabs Industrial Inks, Inc., Escondido, Calif.

[21] Appl. No.: 550,828

[22] Filed: Nov. 14, 1983

Related U.S. Application Data

[63] Continuation-in-part of Ser. No. 559,893, Dec. 12, 1983.

[51] Int. Cl.[3] ..... D06P 5/00

[52] U.S. Cl. ..... 8/508; 8/552; 8/558; 8/614; 8/637; 427/389; 427/426; 428/540

[58] Field of Search ..... 8/508, 558, 614, 637

[56] References Cited

U.S. PATENT DOCUMENTS

| | | | |
|---|---|---|---|
| 3,830,626 | 8/1974 | Rosenberger et al. | 8/485 |
| 4,000,958 | 1/1977 | Hirooka et al. | 8/94.21 |
| 4,190,687 | 2/1980 | Sugiura et al. | 8/94.1 R |
| 4,332,587 | 6/1982 | Kressner et al. | 8/506 |
| 4,421,601 | 12/1983 | Stephan et al. | 8/506 |
| 4,451,264 | 5/1984 | Ulry et al. | 8/508 |

*Primary Examiner*—A. Lionel Clingman
*Attorney, Agent, or Firm*—Sellers and Brace

[57] ABSTRACT

The invention is directed to overprinting a poly(vinyl chloride) resin substrate whose surface, or portion thereof, is colored by solvent soluble dye or by way of a mass solvent soluble dye, with a coloring agent made up of a liquid halogenated hydrocarbon solvent having 1–4 carbon atoms, pigment dispersed in said halohydrocarbon solvent, and a film former, dissolved in said halohydrocarbon solvent, consisting essentially of (a) acrylic resin or (b) a combination of acrylic resin and chlorinated polyolefin, at least 50% by weight of acrylic resin; and heat treating said overprinted substrate to adhere said film former and associated pigment.

10 Claims, No Drawings

OVERPRINTING OF DYE COLORED POLY(VINYL CHLORIDE) RESINS

CROSS REFERENCE TO RELATED APPLICATIONS

This application is a continuation-in-part application of my copending application, Ser. No. 559,893, Filing Date Dec. 12, 1983, For SURFACE COLORING OF POLYVINYL RESINS, by Thomas. D. Ryan.

The instant applicant is a coapplicant of copending application Ser. No. 424,058, Filing Date 09/27/82, for SURFACE COLORING OF POLYVINYL RESINS, by Donald C. Ulry, Charles G. Cosner and Thomas D. Ryan, now U.S. Pat. No. 4,451,264, issued May 29, 1984

BACKGROUND OF THE INVENTION

1. Field of the Invention

The invention is directed to a process for printing onto the surface of a poly(vinyl chloride) resin substrate, virgin or dye colored, which printed matter does not change its configuration on standing, as in storage. Also the invention is directed to overprinting dye colored poly(vinyl chloride) resin, where said overprinted matter retains it own distinct color.

2. Description of the Prior Art

Poly(vinyl chloride) resins are colored in several ways. A dye, or mixture of dyes, soluble in the resin is introduced into resin which is in a more or less molten condition to obtain a dye/resin solution. A dye may be dissolved in a plasticizer and the solution incorporated into the particular resin; in this instance, the dye need not soluble in the resin itself. Or the dye may be added to the molten plasticized resin to obtain the dyed plasticized resin. Or the plasticizer soluble dye may be painted on the plasticized resin surface; on standing the dye migrates into the plasticizer and gives the body color. These are some different procedures for mass dyeing of the plastic body.

More commonly an ink formed from a soluble dye and a solvent therefore, which solvent has some solubility for the resin, giving some penetration into the resin substrate is used to color the surface of the resin body. Dye/halogenated solvent inks, as disclosed in copending application Ser. No. 424,058, filed 09/27/82, by Ulry/Cosner/Ryan, are preferred soluble dye/solvent inks. These have the great advantage of being nonflammable.

The soluble dye/solvent inks have drawbacks. They cannot be used to overprint, as printing or as a colored area, resin which has been mass dyed with soluble dye; the overprint dye adds to the underlying dye color and the overprint color changes to an undesired color. Also the soluble dye/solvent inks cannot be used to overprint lettering or other impressions onto resin which has been mass dyed with soluble dye, or onto virgin resin, because the dye migrates sidewise, blurring the edges of the printed matter and eventually rendering the letter illegible and the impressions become a colored blob.

OBJECTS

A process for printing of virgin poly(vinyl chloride) resin to obtain color stable configurational perimeters, edges, that is, no sidewise migration of dye, as evidenced by no blurring of the edges of printed matter.

A process for overprinting poly(vinyl chloride) resin surface or mass colored by ink soluble in the resin and/or in the plasticizer, if present, where the overprint ink retains its own distinct color, that is, does not add to the underlying color to give an undesired color.

A process for overprinting poly(vinyl chloride) resin, surface or mass colored, by ink soluble in the resin and/or plasticizer, if present, where the overprint matter, such as, letters, numerals, pictures, other impressions, stripes, and the like, retain their distinct configuration, that is, there is no sidewise migration of color from the overprint matter.

SUMMARY OF THE INVENTION

The invention is directed to an improved process for overprinting poly(vinyl chloride) resin substrate, which resin may be mass dyed with soluble dye or surface colored with soluble dye from an ink, where the overprinting is carried out using a liquid, nonflammable color agent consisting essentiall of (i) liquid, nonflammable, halogenated hydrocarbon solvent having 1–4 carbon atoms, where halogen is chloro, fluoro, or both; (ii) pigment dispersed in said solvent; and (iii) film former, dissolved in said solvent, consisting essentially of (a) acrylic resin, or (b) a combination of acrylic resin and chlorinated polyolefin having 2–4 carbon atoms in the monomeric unit, said combination being made up of not more than about equal proportions, by weight, of said acrylic resin and said polyolefin; in other proportions said acrylic resin is predominant; for a time to color said substrate; and heat treating said overprinted substrate to adhere said pigment and said film former, in the overprinted area.

The preferred resins are: poly(vinyl chloride); poly(vinyl dichloride); poly(vinylidene chloride); poly(vinyl chloride/vinyl acetate); and poly(vinyl chloride/vinylidene chloride).

A preferred surface coloring ink consists essentially of (a) liquid, nonflammable, halogenated hydrocarbon solvent having 1–4 carbon atoms, where halogen is chloro, fluoro, or both; and (b) solvent soluble dye. Preferred ink solvent is dichloromethane.

A preferred solvent for said liquid coloring agent is chloroethane or chloroethylene having at least 3 coloro atoms, trichloroethylene and tetrachloroethylene.

In the combination film former, it is preferred that the polyolefin be a chlorinated polypropylene, especially isotactic chlorinated polypropylene.

In general with a combination film former of acrylic resin/chlorinated polypropylene, the heat treatment comprises baking said coloring agent color substrate at on the order of 600° F. for on the order of 30 seconds.

When using an ink solvent of liquid, nonflammable, halogenated hydrocarbon having 1–2 carbon atoms, the surface coloring is done at about room temperature conditions.

The combination printing process is especially suitable for stripeing applied over a solid dye colored surface area.

DETAILED DESCRIPTION

Poly(vinyl chloride) Resins

The poly(vinyl chloride) resins to whose surface overprint coloring the invention is directed may be homopolymers, copolymers, or graft polymers. It is preferred that these resins be quality electrical insulators.

Suitable homopolymers are: poly(vinyl chloride); chlorine enriched poly(vinyl dichloride); poly(vinylidene chloride). Poly(vinyl chloride) is preferred. Suitable copolymers are made by the reaction of two or more of the following monomers: vinyl chloride; vinyl acetate; vinylidene chloride. Preferred copolymers are: poly(vinyl chloride/vinyl acetate) and poly(vinylidene chloride/vinyl chloride).

The poly(vinyl chloride) resins of this invention include both nonplasticized forms (often referred to as 'rigid' resins) and the plasticized forms. Also these resins may include one or more of stabilizer(s), filler(s), colorant(s), etc. The above defined poly(vinyl chloride) resins are available in one or more of the following forms: film, sheet, fiber, foam, pellets and granules.

Halogenated Solvent

The preferred liquid, nonflammable ink consists essentially of a liquid, nonflammable halogenated solvent having 1–4 carbon atoms, where the halogen is chloro, fluoro, or both; and a dye dissolved in said solvent. Preferred solvent has 1–2 carbon atoms; especially preferred solvent is dichloromethane (methylene chloride).

Illustrative ink solvents are; dichloromethane; chloroform; carbon tetrachloride; 1,1,1-trichloroethane; 1,1,2-trichloroethane; 1,1,1,2-tetrachloroethane; 1,1,2,2-tetrachloroethane; trichloroethylene; tetrachloroethylene; hexachloropropylene; hexachlorobutadiene; 1,1,1-dichlorofluoro-2,2,2-dichlorofluoroethane; and 1,1,1-trichloro-2,2,2-trifluoroethane.

The aforesaid chloroethanes and chloroethylenes have significantly less penetrating power (into the resin) than the chloromethanes but are acceptable for most commercial operations. When penetration time is not an economic factor, the chloropropanes and chlorobutanes are acceptable commercial ink solvents.

The boiling point of the solvent will affect the choice because the removal of residual ink solvent may require elevated temperature.

The penetrating power also provides a mild etching action on the defined resin substrate, thereby facilitating mechanical adhesion by the film former component and the pigment dispersed in the coloring agent, which were deposited on the substrate; serving to mark the substrate with durable and legible printed matter.

The liquid coloring agent includes one or more of the afore defined liquid, nonflammable, halogenated hydrocarbons having 1–4 carbon atoms. The liquid, nonflammable chloroethanes and chloroethylenes, each having at least 3 chloro atoms are preferred coloring agent solvents.

Inks

The inks preferred for use in the invention consist essentially of the afore defined halogenated hydrocarbon having 1–4 carbon atoms, and dye(s) soluble in said halogenated solvent. The amount of dye present will be determined by the intensity of color tone needed and by the particular solvent.

Illustrative suitable ink dyes, soluble in the afore defined halogenated solvents, are listed in Table I hereinafter. The dyes are identified by Colour Index name, Colour Index Number, and chemical class. (Colour Index, 3rd Edition, 1971, American Assn of Textile Chemists and Colorists, Lowell, Mass.) All of these dyes are commercially available.

TABLE I

| Colour Index Name | CI Number | Chemical Class |
|---|---|---|
| Solvent Black 7 | 50415:1 | Azine |
| Solvent Black 3 | 26150 | Disazo |

TABLE I-continued

| Colour Index Name | CI Number | Chemical Class |
|---|---|---|
| Solvent Black 27 | 12196 | Azo (1:2 chrome) |
| Solvent Yellow 82 | 18690 | Monoazo |
| Solvent Blue 35 | 61554 | Anthraquinone |
| Solvent Red 122 | 12716 | Azo (chrome complex) |
| Solvent Blue 36 | 61551 | Anthraquinone |

Other suitable dyes are listed in Table II by Dye Trade name and Chemical class; all these are commercially available.

TABLE II

| Dye Trade Name | Chemical Class |
|---|---|
| Neozapon Yellow 081 | Azomethine |
| Orasol Yellow 2GLN | Azo (chrome complex) |
| Orasol Orange RLN | Azo (metal complex) |
| Orasol R G | Monoazo |
| Acetosol Brown GLS | Azo (metalized) |

In general, suitable solvent soluble dyes fall into one of the following chemical classes: anthraquinone, azine, azo, styryl, phthalocyanine, triarylmethane, diphenylmethane, and xanthene.

TABLE III

| Color | Weight % | Component |
|---|---|---|
| Tan | 99.29 | dichloromethane |
| | 0.32 | Acetosol Brown GLS |
| | 0.14 | Acetosol Red 3BLS |
| | 0.21 | Acetosol Yellow RLS |
| | 0.04 | Acetosol Blue RLS |
| Brown | 96.00 | dichloromethane |
| | 1.20 | Solvent Black 27 |
| | 0.80 | Polycran Yellow 5R conc. |
| | 2.00 | Acetosol Orange RLS |
| Yellow | 98.00 | dichloromethane |
| | 1.00 | Neozapon Yellow R |
| | 1.00 | Orasol Yellow 4GN |
| Orange | 98.33 | dichloromethane |
| | 0.57 | Orasol Red G |
| | 1.10 | Orasol Yellow 3GLG |
| Dark Purple | 97.62 | dichloromethane |
| | 1.66 | Solvent Red 122 |
| | 0.72 | Solvent Blue 35 |
| Black | 95.50 | dichloromethane |
| | 4.25 | Solvent Black 27 |
| | 0.25 | Orasol Yellow 2GL |
| Green | 99.70 | dichloromethane |
| | 0.15 | Solvent Blue 36 |
| | 0.15 | Neozapon Yellow GG |
| Pink | 99.46 | dichloromethane |
| | 0.54 | Acetosol Red BLS |
| Gray | 99.02 | dichloromethane |
| | 0.75 | Solvent Black 7 |
| | 0.15 | Orasol Yellow 3GLG |
| | 0.08 | Solvent Blue 36 |
| Black | 95.00 | dichloromethane |
| | 5.00 | Solvent Black 3 |

Liquid Coloring Agent

The liquid coloring used to overprint in this invention consists essentially of hereinbefore defined halogenated hydrocarbon having 1–4 carbon atoms, pigment dispersed in said solvent, and film former dissolved in said solvent.

Film Former

The pigment is adhered to the outer surface of the resin substrate by a film former present in the liquid color agent: the film former is dissolved in the defined solvent. The wet deposited film comprises film former, dispersed pigment, and solvent. On evaporation of the solvent, the printed matter of film former and pigment remains on the substrate.

In this invention the film former may be one or a mixture of acrylic resins (acrylic ester polymers) soluble in the defined solvent, or a combination of acrylic resin and the hereinafter defined chlorinated polyolefin.

Acrylic Resin: One or a mixture of the known acrylic resins which is (are) soluble in the defined solvent may be used alone in the coloring agent as the film former. "Soluble" means soluble enough to meet the requirements of the particular liquid coloring agent. Where commercial quality needs require, two or more different acrylic resins may be dissolved in the defined solvent to make a composite film former. As used herein, "acrylic resin" includes the methacrylic resins, and copolymers of acrylates and methacrylates.

Chlorinated Polyolefins: The chlorinated polyolefins used in the combination film former have 2–4 carbon atoms in the monomeric unit. Typically one or a mixture of ethylene, propylene isomers, and butylene isomers. Isotatic chlorinated polypropylene is a preferred material.

Combination Film Former: The combination film former is limited by the fact that the defined polyolefin alone is not a commercially acceptable film former. The combination is made up of not more than about equal proportions, by weight, of the defined acrylic resin and the defined polyolefin; for example about 4:4 weight parts of each. The two materials may be present in the liquid coloring agent in different weight proportions as long as the defined acrylic resin is the predominant component of the film former combination; for example, 4 weight parts of defined acrylic resin and 2 weight parts of the defined polyolefin.

Pigment

Pigment herein includes inorganic and organic materials that can be colored, colorless, black, white, fluorescent, or metallic and which are insoluble in the defined solvent.

The following illustrative pigments are identified by commercial trade name and by Colour Index Number and Chemical Class.

TABLE IV

| Trade Name | CI No. | Chemical Class |
|---|---|---|
| Monterey Red | 15865 | 2-naphthalene carboxylic, 4-(5-chloro-4-methyl-2-sulfophenyl) |
| Cadmium Maroon | 77197 | Cadmium sulfoselenide |
| RCL-9 (white) | 77891 | Rutile Titanium Dioxide |
| CP Cadmium Primrose | 77199 | Cadmium sulfide |
| Chrome Medium Yellow | 77600 | Lead Chromate |
| Chrome Light Yellow | 77603 | Lead Chromate/Lead Sulfate |
| Phthalocyanine Blue | 74160 | Copper Phthalocyanine |
| Raven 1040 | 77266 | Carbon Black |
| Meteor Black | 77248 | Copper chromite |
| National Red 219-3505 | 15850:1 | Ca salt of G—amino-M—toluene sulfonic acid with 3-hydroxy-2-naphthoic acid. |
| Diarylide Yellow | 21095 | Azo pigment |
| Diarylide Orange | 21101 | Azo pigment |

Preparation

Normally, the particular pigment, or pigment blend, is dispersed into a portion of the selected solvent, or solvent mixture. The selected film form or combination thereof, is dissolved into a portion of the selected solvent. The standard materials plus additional solvent, if needed, are then blended to obtain the desired liquid coloring agent. Normally these operations are carried out at room temperature. However, with the higher boiling solvents or film formers more resistant to solution, some heating may be needed. The final formulation liquid coloring agent is storage stabe at ordinary temperatures and may be stored in plastic containers.

PROCESS OF COLORING AND OVERPRINTING

A film or sheet or shaped article made of the defined resin may be surface color with ink to obtain a solid, dye colored surface. Solid as used herein means 'without gaps or breaks; uniform in tone'. (American Heritage Dictionary of the English Language; 1970) A preferred use of the process is to provide a solid color marking on the outer surface of piping, conduits, tubing, hoses, and electrical wire insulation.

Electrical conductor wire may be insulated with film, sheet, or foam—in terms of thickness—of the defined resin, for example by extrusion.

Typically the dye/solvent solution ink is brought into contact with the defined resin surface area for a time sufficient to color said area, and then the residual solvent is removed from said surface. With the lower boiling solvents, the ink coloring is carried out at on the order of room temperature and the residual solvent is permitted to evaporate at this same temperature. (As used herein, 'on the order of room temperature' includes the range of 68° F. to 86° F.—20° C. to 30° C.) A solid, dye colored surface area is obtained.

Herein 'print or overprint' is intended to mean the production on lettering or other impressions onto a surface from type or other means. Herein "blur" is intended to mean: to make indistinct and hazy in outline or appearance. Herein a 'blob' is intended to mean: a shapeless splotch or daub of color.

The dye colored surface of the defined resin is overprinted with the defined liquid coloring agent by suitable means, well known in this art. For example, stripes running around the circumference of electrical wire insulation are applied with an offset printing wheel.

Normally the liquid coloring agent is applied to the colored surface at about room temperature. The time of contacting is sufficient to deposit an agent film of the desired thickness to show the intended color of the overprint material. Typically the wet film of coloring agent is in a depth (thickness) of about 1–5 thousandths of an inch (0.001–0.005).

The overprinted substrate is then heat treated to evaporate the solvent and to adhere pigment and film former to the substrate. In some instances, about room temperature may be sufficient to evaporate low boiling solvent and to adhere the film former/pigment film. In other instances, elevated temperatures, such as 400°–600° F., for a short time—to avoid damage to the various resins—such as, 15–40 seconds exposure to the heat, is used to bake the film former/pigment film and to adhere firmly the film to the substrate surface.

EVALUATION

In this series of evaluation of inks and coloring agents, the original substrate was white poly(vinyl chloride) resin electrical wire insulation, aka virgin resin.

The inks used to surface color the virgin resin, solid coloring, were made up at room temperature by simple mixing, and consisted of:

| Weight % | Component |
|---|---|
| 98.33 | Dichloromethane, OR 1,1,1-trichloroethane |
| 1.10 | Orasol Yellow 3GLG (Solvent Yellow 48) |
| 0.57 | Orasol Red G (Solvent Red 125) |

1.

The virgin resin insulated wire was first solid colored by contacting the dichlormethane ink and the resin by means of an immersion applicator. The ink is wiped from the insulation surface with a tight fitting silicone wiper. The residual solvent quickly evaporates at ordinary room temperature. No post heating was needed.

The dry orange coloring was adherent to the resin substrate and was capable of accepting the handling such wire insulation gets in commerce without loss of any significant amount of the color. This colored insulation was suitable commercial color coded usage.

2.

The virgin resin was solid colored using the trichloroethane ink following the procedure of "1.". An acceptable solid color dyed wire was obtained.

It was observed that the trichloroethane ink did not migrate into the resin as quickly as did the dichloromethane ink—has less penetrating power. The trichloroethane ink would require a longer contact time to obtain an equal quality colored product, that is, equal durability and color intensity (chroma).

3.

It was observed that inks as in "1." using nonflammable chloropropane and chlorobutane solvents, at equal contacting time, gave solid colored resin substrate significantly inferior in penetrating power to the trichloroethane ink.

4.

Virgin resin wire was striped using several dichlormethane inks, each a different color, in attempts to color striped coded wire. It was observed that in storage the edges of the stripes blurred because of sidewise migration of the dye in the resin. Prolonged storage produced stripes so indistinct as to be unacceptable.

Attempts to imprint lettering on the surface of the virgin resin substrate failed. On standing, the letters lost edge sharpness (configurational stability) and became blurry; eventually the letters lost so shape because of sidewise migration of the dye that the letters became mere blobs, of no value in commerce.

Attempts to overprint a solid dye colored resin substrate with letters, resulted in immediate additon of the underlying color and the overprint color, giving some other color. In storage colors migrated to give a product of no commercial value.

Overprinting

For convenience in testing, standard solutions were made as follows: Solution A consisted of a trichloroethylene solution of Rohm and Haas Thermoplastic Acryloid A-11 acrylic resin. Solution B consisted of a trichloroethylene solution of Polycoat CP-30, East Coast Chemical Co., isotactic chlorinated polypropylene.

Pigment Dispersion: A standard colored dispersion of pigments in trichloroethylene was made by sand milling at room temperature. Tetrachloroethylene for final blending was laid in. The final formulation was prepared by blending the appropriate amounts of the particular solutions needed, at room temperature. In each instance, the final formulation was a smooth, homogeneous dispersion of pigment in the solvent/film former solution.

Printing Procedure: The formulation was applied to the solid, dye colored electrical wire insulation with a photoengraved offset printing wheel, overprinting one or more colored stripes. The over-printed wire was then passed through a baking oven maintained at about 600° F. for a baking time of about 30 seconds.

After the heat treatment the printed insulated wire was inspected for acceptability for commercial use; the following criteria formed the acceptability standards:

(a) Legibility, which is readibility of the overprinted matter.

(b) Adherence, degree of, of the printed matter to the solid dye colored substrate.

(c) Flexibility of the overprinted film: This is a measure of brittleness which is evidence of low adherence, observed by peeling of the printed matter film and/or cracks in that film.

(d) Handling Durability: This measures the capability of the overprinted matter to accept the abuse the electrical wire receives in commercial use without loss of any significant amount of color or legibility of the printed matter.

(e) Organic Solvent Resistance: Defluxing agents are used when one end of the electrical wire is connected to another end of electrical wire by a soldered joint. These defluxing agents include one or more organci solvents, which organic solvents are known to attack some types of resins used in printed matter on the insulation. Such organic solvent attack causes a decrease in legibility, and may cause peeling or flaking of the printed matter film.

(f) Storage Life: The ability of the liquid coloring agent to maintain its physical integrity in storage, on the shelf, over a commercially acceptable time period is measured.

Commercial acceptability requires the overprinted matter to meet at least the minimum standard for each of the above evaluation procedures. Individual formulations may be better quality in one or more requirements than other formulations, but a single "unsatisfactory" finding bars commercial acceptablity of that formulation.

5.

The coloring agent formulation used in evaluating several film formers had the following composition:

| Weight % | Component |
|---|---|
| 56.13 | Trichloroethylene |
| 28.90 | Tetrachloroethylene |
| 0.71 | Chrome Light Yellow (CI 77603) |
| 1.37 | Chrome Light Yellow (CI 77600) |
| 1.58 | Rutile Titanium Dioxide (CI 77891) |
| 11.31 | Film Former |

In this Test 5, the film former was Rohm and Haas Thermoplastic Acryloid A-11 acrylic resin.

Acceptability: The evaluation of the overprinted stripes on the solid dye colored resin substrate showed: High quality adherence, legibility, and storage life. The handling durability and defluxing organic solvent resistance were satisfactory. The stripes showed some slight brittleness, evidenced by cracks. The overall rating was that is formulation was a liquid coloring agent acceptable for commercial use in overprinting use.

6.

In Test 6, the acrylic resin film former was replaced by Polycoat CP-30 isotactic chlorinated polypropylene from East Coast Chemical Co. The overprinted matter showed an unsatisfactory degree of adherence, making this formulation not acceptable.

7.

In this test, the film former was:

| Weight % | Film Former |
|---|---|
| 7.19 | Thermoplastic Acryloid A-11 |
| 4.12 | Isotactic chlorinated Polypropylene, Polycoat CP-30 |

Acceptability: The overprinted matter showed: High quality with respect to adherence, flexibility, legibility, storage life, handling durability, and defluxing organic solvent resistance. This formulation is a superior performance liquid coloring agent.

8.

In this test, the film former was:

| Weight % | Film Former |
|---|---|
| 7.31 | Acryloid AT-50 Thermoset Acrylic Resin from Rohm and Haas |
| 4.00 | Acryloid B-82 thermoplastic Acrylic Resin from Rohm and Haas |

Acceptability: The overprinted matter showed: High quality with respect to adherence, flexibility, legibility, storage life, and handling durability. The resistance to defluxing agent organic solvent was somewhat less than Test 7 but was satisfactory for commerce. Overall this formulation is a liquid coloring agent acceptable for commercial use.

9.

In this test, a series of striped electrical insulation wire. In all instances, except one, the insulation was solid dye colored using dichloromethane/soluble dye ink. The stripes were applied using various liquid coloring agents. The dyeing and overprinting procedures were as described earlier in the evaluation section herein.

Virgin resin substrate: The virgin resin insulated wire was printed with stripes encirclingg the wire. One narrow bright red stripe and another broader bright stripe were printed. The final product was satisfactory for commercial use. The stripes after prolonged shelf time show no blurring of edges and no change in legibility—there was no sidewise migration of color.

The following tabulation shows various combinations of solid dye colored resin substrate and stripes overthereon. Each of these combinations was rated as acceptable for commercial use.

| Resin Substrate Color | Stripes - Color |
|---|---|
| Maroon | One narrow green |
| Maroon | One narrow yellow |
| Maroon | One intermediate white |
| | One intermediate yellow |
| Blue | One narrow white |
| | One narrow yellow |
| | One narrow red |
| Blue | One narrow black |
| Blue | One narrow white |
| | One narrow yellow |
| | One narrow orange |
| Blue | One intermediate maroon |
| Yellow | One intermediate dark blue |
| Yellow | One narrow blue |
| | One intermediate blue |
| Apple Green | One intermediate white |
| | One intermediate orange |
| | One narrow yellow |
| Black | One narrow green |
| Black | One narrow yellow |
| | One intermediate yellow. |

The combinations provided excellent legibility of the color coding; the sharp edged lines were readily evident over the solid color and the difference in width was readily perceived. The overprinted stripes retained their true applied color over prolonged storage and there was no blurring of the sharp edges.

Thus having described the invention what is claimed is:

1. In the process of overprinting on poly(vinyl chloride) resin substrate colored by solvent soluble dye present within said poly(vinyl chloride) resin mass or deposited on the surface of said poly(vinyl chloride) resin, the improvement which comprises:

overprinting at least a part of the surface of said dye colored poly(vinyl chloride) resin substrate with a liquid, nonflammable coloring agent consisting essentially of (i) liquid, nonflammable, halogenated hydrocarbon solvent having 1–4 carbon atoms, where halo is chloro, fluoro, or both;

(ii) pigment dispersed in said halohydrocarbon solvent; and (iii) film former, dissolved in said halohydrocarbon solvent consisting essentially of (a) a resin selected from the class consisting of acrylic resins, methacrylic resins, and resin copolymers or acrylates and methacrylates; or (b) a combination of said resin defined in (a) above and isotactic chlorinated polypropylene, said combination having at least 50% by weight of said resin defined in (a) above;

for a time to color said substrate surface; and heat treating said overprinted substrate to adhere said pigment and said film former, in the overprinted area.

2. In the process of claim 1 wherein said poly(vinyl chloride) resin is poly(vinyl chloride); poly(vinyl dichloride); poly(vinylidene chloride); poly(vinyl chloride/vinyl accetate); or poly(vinyl chloride/vinylidene chloride).

3. In the process of claim 1 wherein said substrate surface color is deposited from a liquid, nonflammable ink consisting essentially of (a) liquid, nonflammable, halogenated hydrocarbon solvent having 1–4 carbon atoms, where halogen is chloro, fluoro, or both; and (b) solvent soluble dye.

4. In the process of claim 3 wherein said halogenated hydrocarbon solvent is dichloromethane.

5. In the process of claim 1 wherein said solvent of said liquid coloring agent is chloroethane or chloroethylene each having at least 3 chloro atoms.

6. In the process of claim 1 wherein said heat treatment comprises baking said overprinted colored substrate at on the order of 600° F. for on the order of 30 seconds.

7. A process for overprinting a substrate formed from dye colored poly(vinyl chloride) resin capable of electrical insulation use, which process comprises:

I (1) contacting the surface area of said poly(vinyl chloride) resin with an ink consisting essentially of liquid, nonflammable, halogenated hydrocarbon solvent having 1–2 carbon atoms where halogen is chloro, fluoro, or both and dye dissolved in said ink solvent;

(2) at about room temperature, for a time sufficient to color said poly(vinyl chloride) resin surface area; and (3) removing residual solvent from said poly(vinyl chloride) resin surface area to obtain a solid dye colored surface area; and

II (A) overprinting said dye colored surface with a liquid, nonflammable coloring agent consisting essentially of (i) liquid chloroethane or chloroethylene, each having at least 3 chloro atoms, solvent;

(ii) pigment dispersed in said chlorosolvent; and (iii) film former, dissolved in said chlorosolvent, consisting essentially of (a) a resin selected from the class consisting of acrylic resins, methacrylic resins, and resin copolymers of acrylates and methacrylates; or (b) a combination of said resin defined in (a) above and isotactic chlorinated polypropylene, said combination having at least 50% by weight of said resin defined in (a) above;

(B) for a time to color said overprinted area; and (C) heat treating said overprinted substrate to adhere said pigment and said film former, in the overprinted area.

8. The process of claim 7 wherein said coloring agent solvent is dichloromethane.

9. The process of claim 7 wherein said coloring agent solvent is chloroethylene having at least 3 chloro atoms.

10. The process of claim 7 wherein said overprinting consists of at least one stripe of a color distinctly different from the underlying solid, dye colored surface.

* * * * *

UNITED STATES PATENT AND TRADEMARK OFFICE

CERTIFICATE OF CORRECTION

PATENT NO. : 4,536,184

DATED : 8/20/85

INVENTOR(S) : RYAN

It is certified that error appears in the above-identified patent and that said Letters Patent is hereby corrected as shown below:

Col. 10, Claim 1, line 49, change "or", first occurrence to --of--.

Signed and Sealed this

*Sixth* Day of *May 1986*

[SEAL]

*Attest:*

DONALD J. QUIGG

*Attesting Officer*

*Commissioner of Patents and Trademarks*